US010336431B2

(12) United States Patent
Tokuda

(10) Patent No.: US 10,336,431 B2
(45) Date of Patent: Jul. 2, 2019

(54) OUTBOARD MOTOR

(71) Applicant: YAMAHA HATSUDOKI KABUSHIKI KAISHA, Iwata-shi, Shizuoka (JP)

(72) Inventor: Kota Tokuda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/823,666

(22) Filed: Nov. 28, 2017

(65) Prior Publication Data

US 2018/0208288 A1 Jul. 26, 2018

(30) Foreign Application Priority Data

Jan. 26, 2017 (JP) ..... 2017-012295

(51) Int. Cl.

| | |
|---|---|
| ***B63H 20/10*** | (2006.01) |
| ***B63H 20/12*** | (2006.01) |
| ***B63H 21/21*** | (2006.01) |
| ***F02D 41/22*** | (2006.01) |
| ***F02D 41/24*** | (2006.01) |
| ***F02D 41/26*** | (2006.01) |
| ***F02B 61/04*** | (2006.01) |

(52) U.S. Cl.

CPC ..... *B63H 21/21* (2013.01); *B63H 20/10* (2013.01); *B63H 20/12* (2013.01); *F02B 61/045* (2013.01); *F02D 41/22* (2013.01); *F02D 41/2403* (2013.01); *F02D 41/26* (2013.01); *B63H 2021/216* (2013.01); *F02D 2200/503* (2013.01)

(58) Field of Classification Search

CPC ..... B63H 21/21; B63H 20/12; B63H 20/10; B63H 2021/216; F02D 41/22; F02D 41/26; F02D 41/2403; F02D 2200/503; F02B 61/045

See application file for complete search history.

(56) References Cited

U.S. PATENT DOCUMENTS

| | | | | |
|---|---|---|---|---|
| 5,293,076 | A | 3/1994 | Fukui | |
| 5,685,802 | A | 11/1997 | Kanno | |
| 6,273,771 | B1 * | 8/2001 | Buckley | B63H 21/213 114/144 RE |
| 6,446,593 | B1 * | 9/2002 | Suganuma | F02B 61/045 123/198 D |
| 7,449,994 | B1 * | 11/2008 | Koerner | F02B 61/045 340/438 |
| 2001/0049579 | A1 * | 12/2001 | Fujino | G01M 15/04 701/114 |
| 2005/0287880 | A1 | 12/2005 | Okuyama | |

FOREIGN PATENT DOCUMENTS

| | | | |
|---|---|---|---|
| JP | 11-193741 | A | 7/1999 |

* cited by examiner

*Primary Examiner* — Anthony D Wiest

(74) *Attorney, Agent, or Firm* — Keating and Bennett, LLP

(57) ABSTRACT

An outboard motor includes a plurality of electric actuators including an electric steering actuator and an electric tilt actuator, a power-source voltage detector that detects a power-source voltage in the outboard motor, an ECU, and a memory. If a power-source voltage detected by the power-source voltage detector becomes lower than a predetermined threshold value and if the plurality of electric actuators are simultaneously driven, the ECU determines that a voltage variation event has occurred. Event information including the number of occurrences of the voltage variation event is recorded in the memory.

7 Claims, 6 Drawing Sheets

FIG. 6

| Number of occurrences of voltage variation event : Three times |
| --- |
| First occurrence time: December 10, 2016<br>Second occurrence time: January 7, 2017<br>Third occurrence time: March 20, 2017 |

OUTBOARD MOTOR

CROSS REFERENCE TO RELATED APPLICATIONS

This application claims the benefit of priority to Japanese Patent Application No. 2017-012295 filed on Jan. 26, 2017. The entire contents of this application are hereby incorporated herein by reference.

BACKGROUND OF THE INVENTION

1. Field of the Invention

The present invention relates to outboard motors.

2. Description of the Related Art

An outboard motor disclosed in Japanese Patent Application Publication No. 11-193741 includes an internal combustion engine, an engine control circuit that performs ignition control, fuel injection control, etc., for driving the engine, various sensors attached to the engine, and an alarm device. The various sensors and a power source that supplies electric power to the outboard motor are connected to the alarm device. When any of the sensors breaks down, the alarm device actuates a buzzer and an LED, and hence alerts a driver of the breakdown of the sensor.

The inventor of preferred embodiments of the present invention has been developing an outboard motor that includes a plurality of electric actuators having a much higher power consumption than various sensors. In this arrangement, there is a concern that a power-supply voltage in the outboard motor will momentarily fall when the plurality of electric actuators are simultaneously driven, and therefore it is desired that the power source of a vessel on which the outboard motor is mounted has a sufficient capacity. However, if the capacity of the power source is insufficient because of some reason, there is a concern that the timing of control executed by an engine control circuit regarding the pressure of a fuel to be supplied to the engine (so-called fuel pressure) will be delayed by a decrease in a supply voltage supplied to the engine control circuit in response to a decrease in a power-source voltage. If the control timing is delayed, there is a concern that a fuel-pressure variation will occur. Fuel-pressure variation is a possible cause of engine rotation fluctuation.

When an engine defect, such as rotation fluctuation, becomes a problem in an outboard motor, much time will be consumed to specify its cause if information about the engine operations is insufficient.

SUMMARY OF THE INVENTION

In order to overcome the previously unrecognized and unsolved challenges described above, preferred embodiments of the present invention provide outboard motors that generate a thrust while using an internal combustion engine as a power source and that each include a plurality of electric actuators, a power-source voltage detector, a controller configured or programmed to include an event occurrence detector, and an event information recorder. The power-source voltage detector detects a power-source voltage in the outboard motor. The event occurrence detector determines that a voltage variation event has occurred if a power-source voltage detected by the power-source voltage detector becomes lower than a predetermined threshold value and if the plurality of electric actuators are simultaneously driven. The event information recorder records event information including the number of occurrences of the voltage variation event.

According to a preferred embodiment of the present invention, the outboard motor uses an internal combustion engine as a power source, and includes the plurality of electric actuators. In the outboard motor, if a power-source voltage in the outboard motor detected by the power-source voltage detector becomes lower than a predetermined threshold value and if the plurality of electric actuators are simultaneously driven, a determination that a voltage variation event has occurred is made by the event occurrence detector. Thereafter, event information including the number of occurrences of the voltage variation event is recorded by the event information recorder. In other words, regardless of whether a defect has occurred in the internal combustion engine, information about the operation of the internal combustion engine that might cause the defect is recorded as event information. Therefore, when a defect has occurred in the internal combustion engine, it is possible for an operator, such as a service person, to utilize event information as a hint for specifying the cause of the defect, and therefore it is possible to shorten the period of time to specify the cause of the defect.

In a preferred embodiment of the present invention, the outboard motor preferably further includes a mounting bracket to mount the outboard motor on a hull, a tilt bracket, and an outboard motor body. The tilt bracket is attached so as to be tiltable with respect to the mounting bracket in an up-down direction, and the outboard motor body is mounted so as to be steerable rightwardly and leftwardly with respect to the tilt bracket. In this case, the plurality of electric actuators preferably include an electric tilt actuator that tilts the tilt bracket with respect to the mounting bracket and an electric steering actuator that steers the outboard motor body rightwardly and leftwardly with respect to the tilt bracket.

According to this preferred embodiment, if a power-source voltage in the outboard motor becomes lower than a predetermined threshold value and if the electric tilt actuator and the electric steering actuator are simultaneously driven, a determination that a voltage variation event has occurred is made by the event occurrence detector. Thereafter, event information including the number of occurrences of the voltage variation event is recorded by the event information recorder. In this case, when event information is utilized to specify the cause of a defect of the internal combustion engine, the operator is able to study a relationship between the cause of the defect and the simultaneous driving of the electric tilt actuator and the electric steering actuator, and therefore the operator is able to specify the cause of the defect in a short time.

In a preferred embodiment of the present invention, the event information recorder preferably records the event information that includes the number of occurrences of the voltage variation event and the occurrence time of the voltage variation event.

According to this preferred embodiment, the operator is able to identify the occurrence time of a voltage variation event from event information when the operator utilizes the event information in order to specify the cause of a defect of the internal combustion engine, and therefore it is possible to further shorten the period of time required to specify the cause of the defect of the internal combustion engine.

In a preferred embodiment of the present invention, in a case in which a power-source voltage detected by the power-source voltage detector becomes lower than a predetermined threshold value and in which the plurality of electric actuators have been simultaneously driven, the event occurrence detector preferably determines that the voltage variation event has occurred if a time difference in driving-start timing between the plurality of electric actuators falls within a predetermined period of time.

According to this preferred embodiment, the fact that the occurrences of rush currents have coincided with each other because a time difference in driving-start timing between the plurality of electric actuators simultaneously driven falls within a predetermined period time is able to considered as a possible cause for which the power-source voltage has become lower than the predetermined threshold value. When event information is utilized to specify the cause of a defect of the internal combustion engine, the operator is able to consider rush currents, and hence is able to specify the cause of the defect in a short time.

In a preferred embodiment of the present invention, the outboard motor preferably further includes an event information output that outputs event information recorded in the event information recorder.

According to this preferred embodiment, event information is output by the event information output. Therefore, when a defect occurs in the internal combustion engine, the operator is able to specify the cause of the defect of the internal combustion engine in a short time by referring to and using the output event information.

In a preferred embodiment of the present invention, the event information output preferably includes a communicator that communicates with an information collector provided outside the outboard motor.

According to this preferred embodiment, it is possible to transmit event information to the information collector by allowing the communicator to communicate with the information collector outside the outboard motor. As a result, even when the operator is away from the outboard motor, the operator is able to specify the cause of the defect of the internal combustion engine in a short time by using event information transmitted to the information collector.

In a preferred embodiment of the present invention, the internal combustion engine preferably includes a fuel injector and a high-pressure fuel pump that supplies fuel to the fuel injector. In this case, the controller is configured or programmed to perform fuel-pressure feedback control of the high-pressure fuel pump.

According to this preferred embodiment, if the power-source voltage in the outboard motor becomes lower than the predetermined threshold value, the timing of the fuel-pressure feedback control performed by the controller will be delayed because the supply voltage to the controller decreases, and there is a concern that a fuel-pressure variation will occur. The fuel-pressure variation is a possible cause of rotation fluctuation of the internal combustion engine.

However, in the outboard motor, if the power-source voltage in the outboard motor that is detected by the power-source voltage detector becomes lower than the predetermined threshold value and if the plurality of electric actuators are simultaneously driven, the event occurrence detector determines that a voltage variation event has occurred. Furthermore, event information including the number of occurrences of the voltage variation event is recorded by the event information recorder. In other words, regardless of whether a rotation fluctuation has occurred or not, information about the operation of the internal combustion engine that might cause the rotation fluctuation is recorded as event information. Therefore, when the rotation fluctuation of the internal combustion engine occurs, it is possible for an operator to utilize event information to determine the cause of the rotation fluctuation, and therefore it is possible to shorten the period of time to specify the cause of the rotation fluctuation.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 6 is a view showing the contents of event information recorded in the outboard motor.

DETAILED DESCRIPTION OF THE PREFERRED EMBODIMENTS

Figure 1:
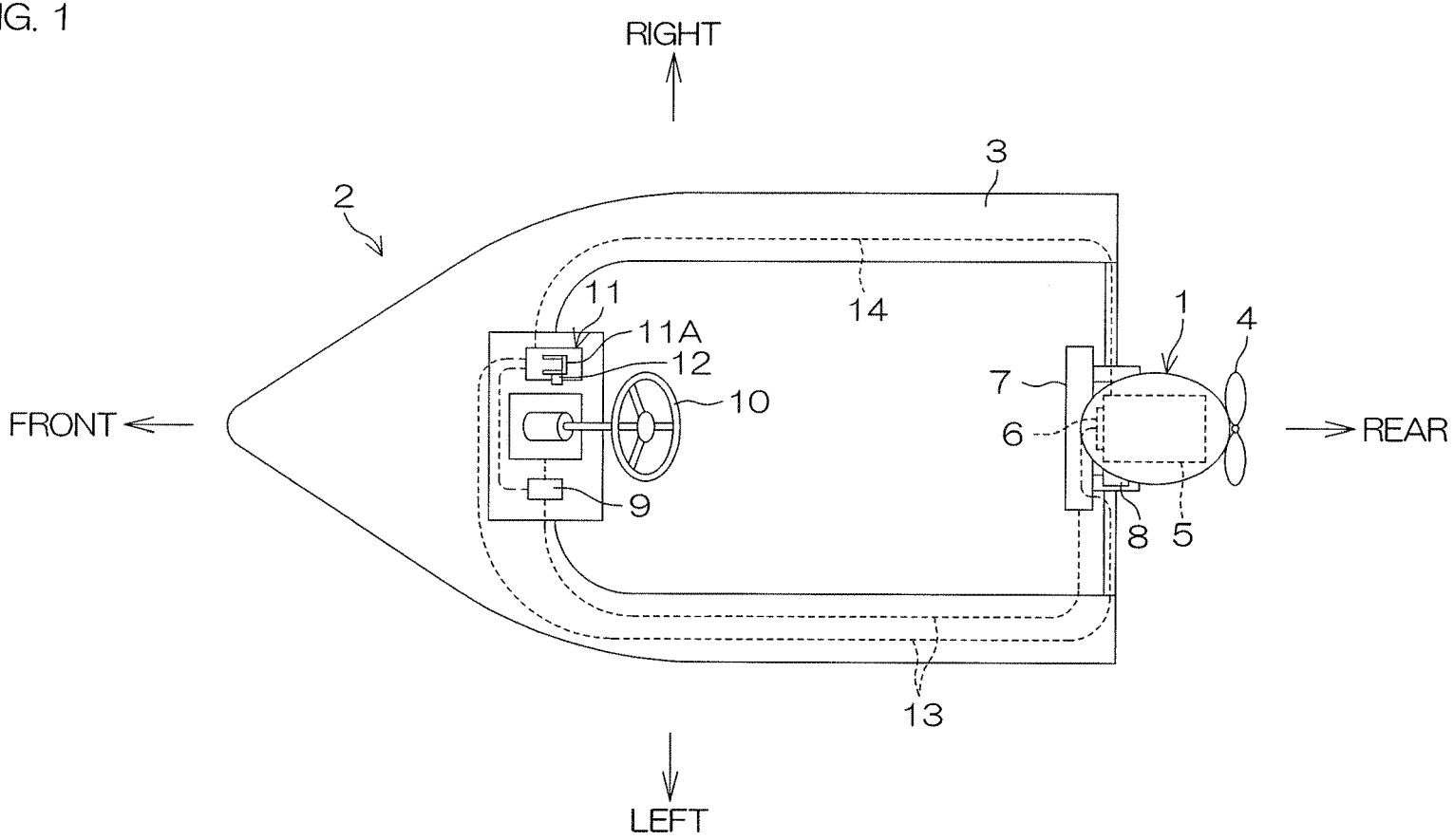
FIG. 1 is a schematic plan view showing an arrangement of a vessel that includes an outboard motor according to a preferred embodiment of the present invention.

Preferred embodiments of the present invention will be hereinafter described in detail with reference to the accompanying drawings. FIG. 1 is a schematic plan view to showing an arrangement of a vessel 2 that includes an outboard motor 1 according to a preferred embodiment of the present invention. The vessel 2 includes a hull 3. The outboard motor 1 is attached to a rear portion of the hull 3, and generates a thrust that propels the hull 3 due to the rotation of a propeller 4.

The outboard motor 1 includes an internal combustion engine 5 that is a power source that rotates the propeller 4 and an ECU (Engine Control Unit) 6 that controls the outboard motor 1. The outboard motor 1 additionally includes a steering device 7 that steers the outboard motor 1 in a left-right direction and a tilt device 8 that tilts the outboard motor 1 in an up-down direction. The hull 3 includes an SCU (Steering Control Unit) 9 that controls the steering device 7, a steering wheel 10, a remote control 11, and a tilt switch 12. The SCU 9 may be included in the outboard motor 1.

The steering wheel 10 is electrically connected to the SCU 9 through a CAN (Controller Area Network) 13 including a communication line, such as a harness. When the steering wheel 10 is operated by a vessel operator, an electric signal according to the operational direction and the operational amount of the steering wheel 10 is input to the SCU 9 through the CAN 13, and the SCU 9 controls the steering device 7 in accordance with the electric signal. As a result, the steering device 7 steers the outboard motor 1 in the left-right direction, and therefore the vessel 2 is steered by a change in the direction of a thrust provided to the hull 3 in the left-right direction. A steer-by-wire system is provided in this way in the vessel 2.

The remote control 11 is electrically connected to the ECU 6 and to the SCU 9 through the CAN 13. The information that the steering wheel 10 has been operated, e.g., information about a steering angle of the outboard motor 1 resulting from the operation of the steering wheel 10 is input from the SCU 9 to the ECU 6 through the remote control 11. The remote control 11 preferably includes an operation lever 11A mechanically joined to the outboard motor 1 via an operation cable 14. When the vessel operator operates the operation lever 11A, its operating force is transmitted to the outboard motor 1 by the operation cable 14. As a result, the shift position of the outboard motor 1 is changed. In other words, the operation of the operation lever 11A makes it possible to switch the direction of a thrust of the outboard motor 1 to a forward direction and to a backward direction, and makes it possible to achieve a neutral state in which the power of the internal combustion engine 5 is not transmitted to the propeller 4. Additionally, the operating force of the operation lever 11A is transmitted to a throttle valve (not shown) of the internal combustion engine 5 of the outboard motor 1. As a result, the throttle opening degree of the throttle valve is changed, and the output of the internal combustion engine 5 in the outboard motor 1 is changed by the operation of the operation lever 11A.

The tilt switch 12 is disposed at the operation lever 11A or the like in the remote control 11, and is electrically connected to the ECU 6 through the CAN 13. When the tilt switch 12 is operated so as to be pressed down by the vessel operator, an electric signal according to an energization time resulting from the operation of the tilt switch 12 is input to the ECU 6 through the CAN 13, and the ECU 6 controls the tilt device 8 in accordance with the electric signal. As a result, the tilt device 8 tilts the outboard motor 1 in the up-down direction.

Figure 2:
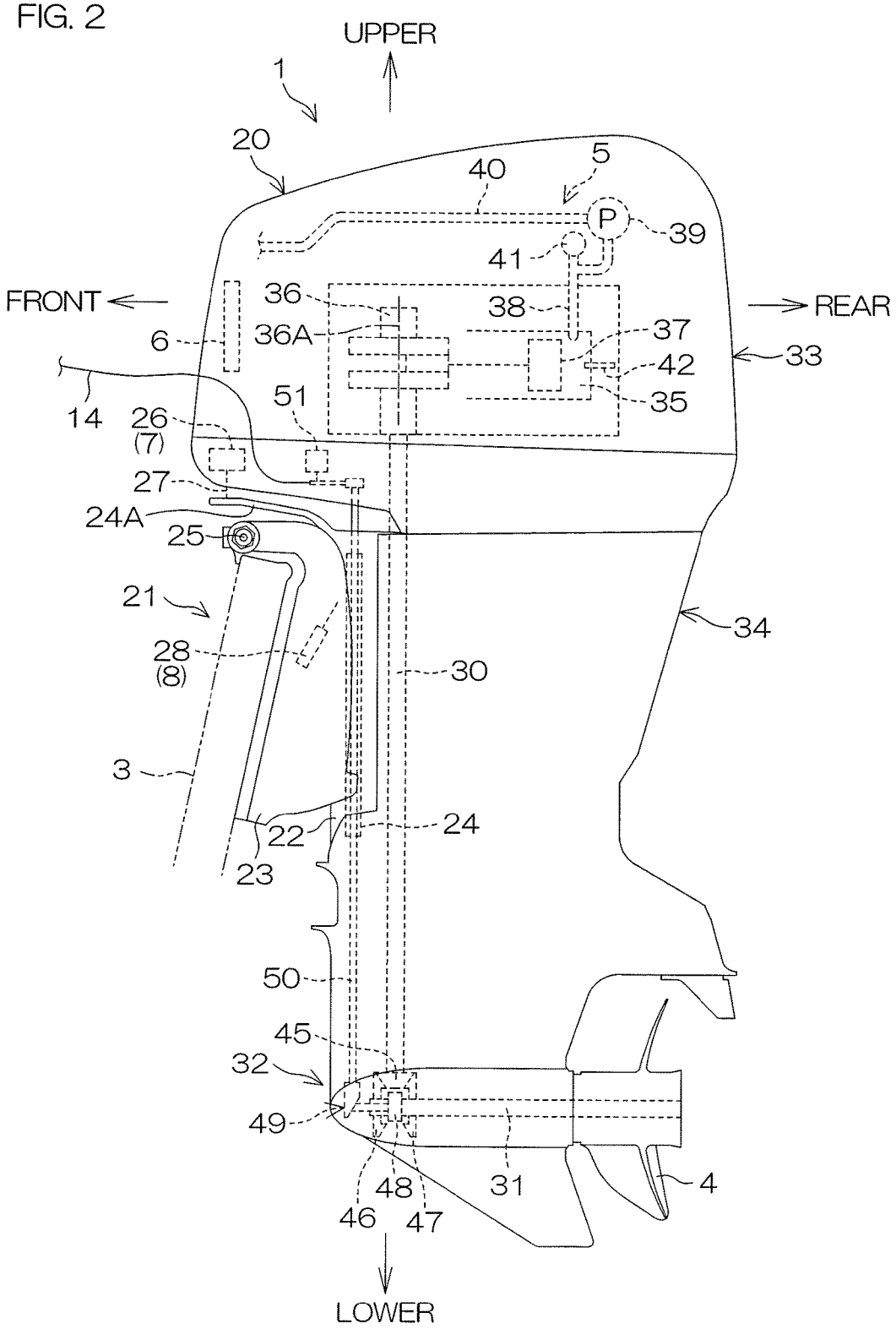
FIG. 2 is a schematic side view of the outboard motor.

FIG. 2 is a schematic left side view of the outboard motor 1. The left side in FIG. 2 is a front side of the outboard motor 1, and the right side in FIG. 2 is a rear side of the outboard motor 1. The near side in a direction perpendicular to the plane of FIG. 2 is a left side of the outboard motor 1, and the far side in the direction perpendicular to the plane of FIG. 2 is a right side of the outboard motor 1.

The outboard motor 1 includes an outboard motor body 20 and a mounting mechanism 21. The mounting mechanism 21 includes a tilt bracket 22, a mounting bracket 23, a steering shaft 24, and a tilt shaft 25. The steering shaft 24 is disposed so as to extend in the up-down direction. The tilt shaft 25 is horizontally disposed so as to extend in the left-right direction. The tilt bracket 22 is attached to the outboard motor body 20 through the steering shaft 24. The mounting bracket 23 is attached to the tilt bracket 22 through the tilt shaft 25. The mounting bracket 23 is fixed to the rear portion of the hull 3. As a result, the outboard motor body 20 is attached to the rear portion of the hull 3 in a perpendicular or substantially perpendicular attitude.

The outboard motor body 20 and the tilt bracket 22 are tiltable in the up-down direction around the tilt shaft 25 with respect to the mounting bracket 23. The outboard motor body 20 is tilted with respect to the hull 3 and the mounting bracket 23 by causing the outboard motor body 20 to tilt. The outboard motor body 20 is steerable rightwardly and leftwardly together with the steering shaft 24 with respect to the tilt bracket 22 and the mounting bracket 23.

The steering device 7 includes an electric steering actuator 26 attached to, for example, the outboard motor body 20 and a transmission 27 that transmits a driving force via the electric steering actuator 26. The electric steering actuator 26 includes an electric actuator, such as a motor. The transmission 27 includes, for example, a ball screw or the like that is driven and rotated by the electric steering actuator 26, and is connected to a lever 24A at an upper end of the steering shaft 24. When the vessel operator operates the steering wheel 10, an electric signal is transmitted to the SCU 9. Based on this electric signal, the SCU 9 controls the driving of the electric steering actuator 26. The driving force of the electric steering actuator 26 is transmitted to the steering shaft 24 via the transmission 27 through the lever 24A. As a result, the steering shaft 24 and the outboard motor body 20 steer rightwardly and leftwardly with respect to the tilt bracket 22, and therefore the vessel 2 is steered. The information that the steering wheel 10 has been operated is input from the SCU 9 to the ECU 6 through the remote control 11 and the CAN 13.

The tilt device 8 includes an electric tilt actuator 28 including, for example, an electric motor attached to the tilt bracket 22. The electric tilt actuator 28 includes an electric actuator, such as a motor. When the vessel operator operates the tilt switch 12, an electric signal is transmitted to the ECU 6. Based on this electric signal, the ECU 6 controls the driving of the electric tilt actuator 28. The driving force of the electric tilt actuator 28 is transmitted to the tilt bracket 22. As a result, the tilt bracket 22 and the outboard motor body 20 tilt with respect to the mounting bracket 23.

The outboard motor body 20 includes a driving shaft 30, a propeller shaft 31, and a forward-backward switch 32. The outboard motor body 20 includes a box-shaped or substantially box-shaped engine cover 33 and a hollow casing 34 that extends downwardly from the engine cover 33. The internal combustion engine 5 is contained in the engine cover 33. The driving shaft 30 is disposed in the engine cover 33 and in the casing 34, and extends downwardly from the internal combustion engine 5. The propeller shaft 31 extends in the front-rear direction in a lower portion of the inside of the casing 34. A lower end of the driving shaft 30 is connected to a front end of the propeller shaft 31 via the forward-backward switch 32. A rear end of the propeller shaft 31 protrudes rearwardly from the casing 34. The propeller 4 is attached to the rear end of the propeller shaft 31. The propeller 4 rotates together with the propeller shaft 31.

A combustion chamber 35, a crankshaft 36, and a piston 37 are built into the internal combustion engine 5. The internal combustion engine 5 includes a fuel injector 38 that jets fuel, such as gasoline, directly to the inside of the combustion chamber 35 and a high-pressure fuel pump 39 that supplies fuel to the fuel injector 38. The fuel injector 38 is connected to a fuel hose 40 that extends from a fuel tank (not shown) disposed on the hull 3, and the high-pressure fuel pump 39 is disposed between both ends of the fuel hose 40. More specifically, the fuel hose 40 is connected to the high-pressure fuel pump 39 through a low-pressure fuel pump, a feed pump, not shown, or the like. The internal combustion engine 5 includes a fuel pressure sensor 41 that detects the pressure of fuel supplied from the high-pressure fuel pump 39 to the fuel injector 38, i.e., that detects fuel pressure and an ignition unit 42 that ignites an air-fuel mixture generated in the combustion chamber 35 by allowing the fuel injector 38 to inject fuel.

The crankshaft 36 includes a crankshaft axis 36A that extends in the up-down direction. A lower end of the crankshaft 36 is connected to an upper end of the driving shaft 30. When the air-fuel mixture in the combustion chamber 35 burns after being ignited by the ignition unit 42, the piston 37 rectilinearly reciprocates in the front-rear direction perpendicular to the crankshaft axis 36A. As a result, the crankshaft 36 is driven and rotated around the crankshaft axis 36A while driving and rotating the driving shaft 30.

The forward-backward switch 32 includes a driving gear 45, a first transmitting gear 46, a second transmitting gear 47, a clutch body 48, and a shift mechanism 49, and is contained in the lower portion of the inside of the casing 34 along with the propeller shaft 31. The driving gear 45, the first transmitting gear 46, and the second transmitting gear 47 are, for example, cylindrical bevel gears, respectively.

The driving gear 45 is attached to a lower end of the driving shaft 30. The propeller shaft 31 is disposed below the driving gear 45. The first transmitting gear 46 surrounds a portion of the front end of the propeller shaft 31 in a noncontact state at a location more forward than the driving gear 45, and the second transmitting gear 47 surrounds a portion of the front end of the propeller shaft 31 in a noncontact state at a location more rearward than the driving gear 45. The first transmitting gear 46 and the second transmitting gear 47 are disposed so that a tooth portion of the first transmitting gear 46 and a tooth portion of the second transmitting gear 47 face each other with an interval therebetween in the front-rear direction, and the first transmitting gear 46 and the second transmitting gear 47 are engaged with the driving gear 45. When the driving gear 45 rotates together with the driving shaft 30 in response to the driving of the internal combustion engine 5, the rotation of the driving gear 45 is transmitted to the first transmitting gear 46 and to the second transmitting gear 47. As a result, the first transmitting gear 46 and the second transmitting gear 47 rotate in mutually opposite directions around the propeller shaft 31.

The clutch body 48 includes, for example, a cylindrical dog clutch, and is disposed between the first transmitting gear 46 and the second transmitting gear 47 in a state surrounding the front end of the propeller shaft 31. The clutch body 48 is connected to the front end of the propeller shaft 31 via, for example, a spline. Therefore, the clutch body 48 rotates together with the front end of the propeller shaft 31. Additionally, the clutch body 48 is movable in the front-rear direction with respect to the front end of the propeller shaft 31.

The shift mechanism 49 includes, for example, a shift rod 50 extending in the up-down direction and a neutral switch 51. The shift rod 50 is joined to the operation cable 14. When the vessel operator operates the operation lever 11A of the remote control 11 (see FIG. 1), the shift rod 50 turns around an axis of the shift rod 50 by the input of an operating force of the operation lever 11A from the operation cable 14. The clutch body 48 is moved in the front-rear direction by turning the shift rod 50. The clutch body 48 is disposed at any one of a neutral position, a forward position, and a backward position. A neutral switch 51 detects whether the position of the clutch body 48 is in the neutral position or not. A detection value of the neutral switch 51 is input to the ECU 6.

The neutral position is a position at which the clutch body 48 is engaged neither with the first transmitting gear 46 nor with the second transmitting gear 47, and is a position between the forward position and the backward position. In a state in which the clutch body 48 is located at the neutral position, the rotation of the driving shaft 30 is not transmitted to the propeller shaft 31.

The forward position is a position at which the clutch body 48 is engaged with the first transmitting gear 46, and the backward position is a position at which the clutch body 48 is engaged with the second transmitting gear 47. In a state in which the clutch body 48 is located at the forward position and is connected to the first transmitting gear 46, the rotation of the first transmitting gear 46 is transmitted to the propeller shaft 31, and the propeller 4 normally rotates, and therefore the outboard motor 1 generates a forward thrust. In a state in which the clutch body 48 is located at the backward position and is connected to the second transmitting gear 47, the rotation of the second transmitting gear 47 is transmitted to the propeller shaft 31, and the propeller 4 reversely rotates, and therefore the outboard motor 1 generates a backward thrust.

Next, an electric configuration of the outboard motor 1 will be described with reference to the block diagram of FIG. 3. The ECU 6 includes a memory 60 in which various pieces of information are recorded. In response to the operation of the steering wheel 10 or the tilt switch 12 by the vessel operator, an electric signal is input from the tilt switch 12 to the ECU 6, and an electric signal is input from the steering wheel 10 to the SCU 9. When the electric signal is input to the SCU 9, the information that the steering wheel 10 has been operated as described above is input from the SCU 9 to the ECU 6 via the remote control 11 as another electric signal. When the electric signal is input from the SCU 9, the ECU 6 sets an operation flag concerning the steering wheel 10 so as to become 1 from 0. When the electric signal is input from the tilt switch 12, the ECU 6 sets an operation flag concerning the tilt switch 12 so as to become 1 from 0. When no electric signal is input, the ECU 6 resets the corresponding operation flag so as to become 0 from 1.

The outboard motor 1 additionally includes an EDU (Electronic Driver Unit) 61 that controls operations at least relative to a fuel supply in the internal combustion engine 5. Both the EDU 61 and the fuel pressure sensor 41 are electrically connected to the ECU 6. Both the fuel injector 38 and the high-pressure fuel pump 39 are electrically connected to the EDU 61. The ECU 6 and the EDU 61 are each an example of a controller in a preferred embodiment of the present invention, and perform the fuel-pressure feedback control of the high-pressure fuel pump 39 so that fuel pressure detected by the fuel pressure sensor 41 approaches a target value, and perform the fuel injection control of the fuel injector 38. In detail, the ECU 6 makes a feedback calculation based on a detection result of the fuel pressure sensor 41, and sends a driving signal based on a calculation result to the EDU 61. The EDU 61 drives the fuel injector 38 based on an injector signal that is one of the driving signals received therefrom, and drives the high-pressure fuel pump 39 based on a pump signal. Operations of the ignition unit 42 and the like in the internal combustion engine 5 may be controlled by the ECU 6, or may be controlled by the EDU 61.

The electric tilt actuator 28 is electrically connected to the ECU 6, and the electric steering actuator 26 is electrically connected to the SCU 9. Electric power from a power source 62, such as a battery, disposed in the hull 3 or in the outboard motor 1 is supplied to each electrical component in the outboard motor 1. When the ECU 6 drives the electric tilt actuator 28, the ECU 6 may perform chopper control of, for example, an electric current flowing to the electric tilt actuator 28 so that the rush current values are limited to low values. Likewise, the SCU 9 may perform the chopper control of an electric current flowing to the electric steering actuator 26.

The outboard motor 1 additionally includes a power-source voltage detector 63 and an event information output 64. The power-source voltage detector 63 includes a voltmeter and the like built into the ECU 6, and detects a power-source voltage in the outboard motor 1. The event information output 64 will be described below.

Figure 4:
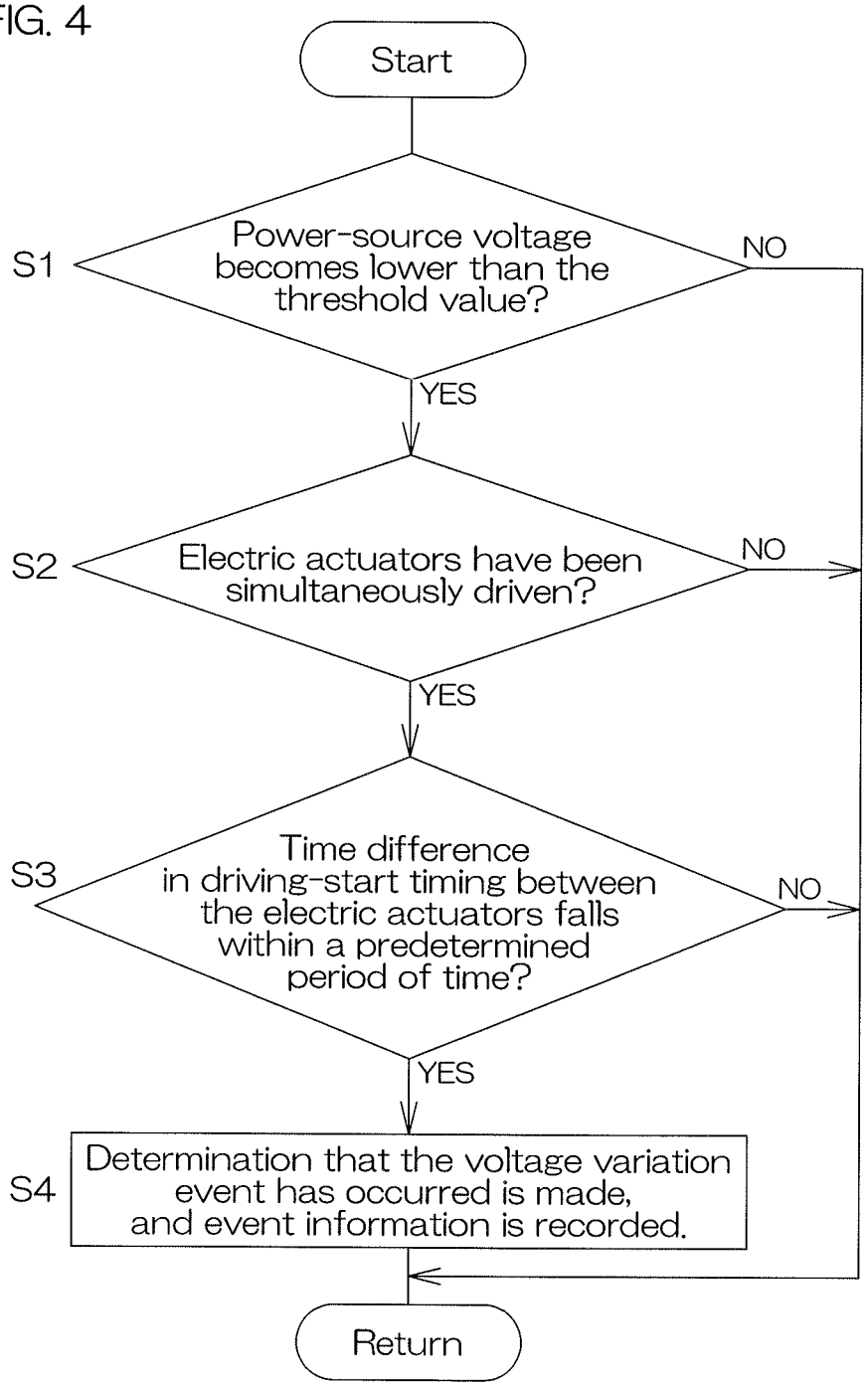
FIG. 4 is a flowchart showing a processing procedure performed in the outboard motor.
Figure 5:
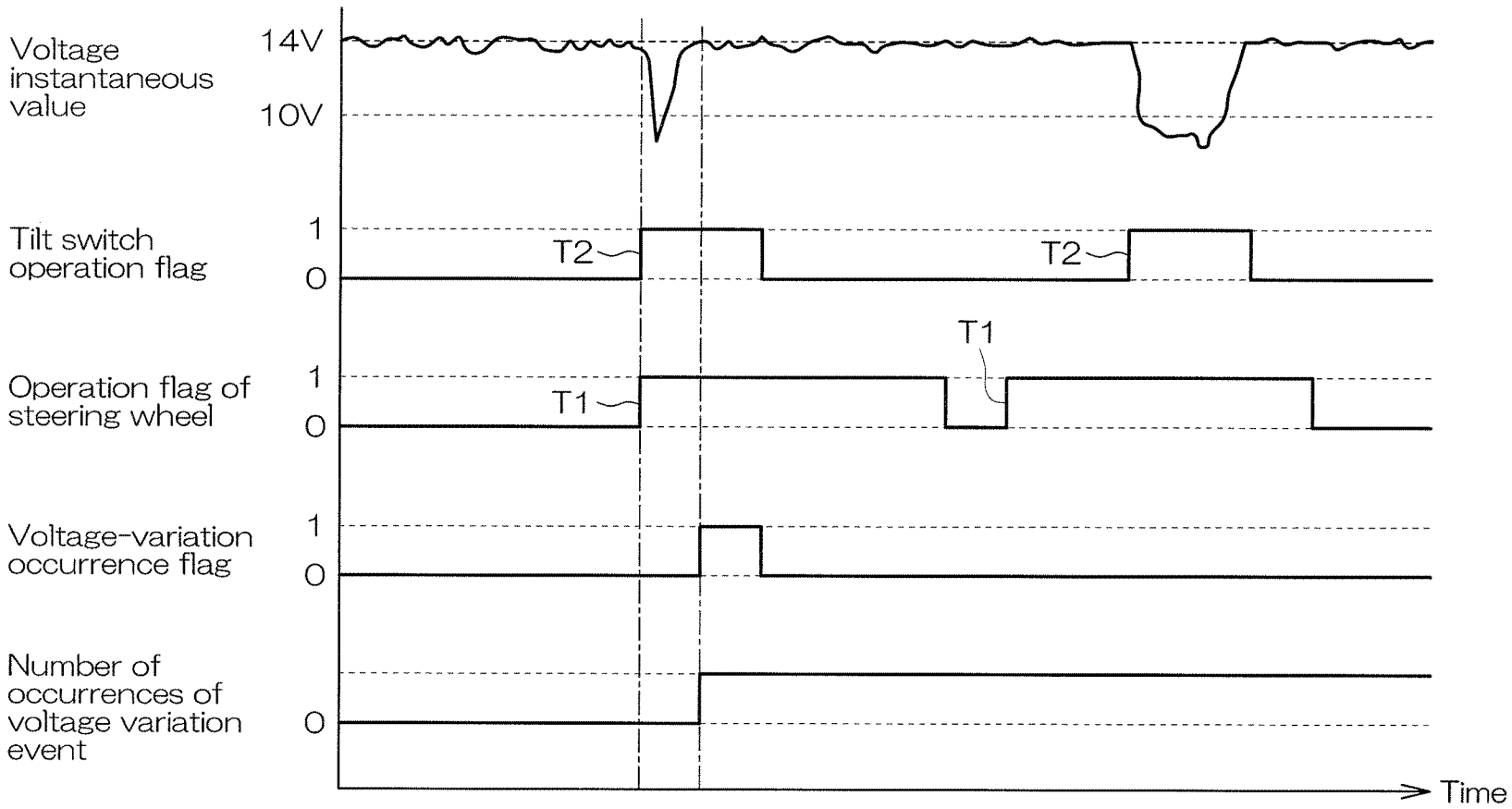
FIG. 5 is a time chart showing a time-dependent change of each variation value in the outboard motor.

FIG. 4 is a flowchart showing a processing procedure performed in the outboard motor 1, in particular, an example of processing that is repeatedly performed by the ECU 6. FIG. 5 is a time chart showing a time-dependent change of each variation value in the outboard motor 1.

Instantaneous values of the power-source voltage in the outboard motor 1 detected by the power-source voltage detector 63 are supplied to the ECU 6 in real time or at little-by-little timing, such as 1 ms timing (see the highest portion of FIG. 5). For example, in a case in which the reference value of the power-source voltage is 14 V, for example, the ECU 6 always monitors whether a power-source voltage detected by the power-source voltage detector 63 is lower than a predetermined threshold value (for example, 10 V that is lower than the reference value beyond a predetermined range) (step S1). If the power-source voltage momentarily becomes lower than the threshold value (step S1: YES), the ECU 6 furthermore ascertains whether the electric steering actuator 26 and the electric tilt actuator 28 are simultaneously driven (step S2).

If the power-source voltage becomes lower than the threshold value and if these electric actuators are simultaneously driven (step S2: YES), the ECU 6 ascertains a time difference in driving-start timing between the electric actuators (step S3). The driving-start timing is a timing at which an electric signal resulting from the operation of the steering wheel 10 or of the tilt switch 12 by the vessel operator is input to the ECU 6, and is a timing at which the operation flag of the steering wheel 10 or of the tilt switch 12 is set. The driving-start timing of the electric steering actuator 26 is referred to as driving-start timing T1, and the driving-start timing of the electric tilt actuator 28 is referred to as driving-start timing T2 (see FIG. 5).

If a time difference between the driving-start timing T1 and the driving-start timing T2 falls within a predetermined period of time (for example, 10 ms or less) (step S3: YES), the ECU 6 determines that a voltage variation event has occurred (step S4). The ECU 6 is an example of an event occurrence detector in a preferred embodiment of the present invention. The voltage variation event is an event that will cause the power-source voltage to rapidly decrease from the reference value, and, herein, is an event in which the driving operations of the plurality of electric actuators are started substantially at the same timing, and these electric actuators are simultaneously driven.

If, in step S4, the ECU 6 determines that the voltage variation event has occurred, a voltage-variation occurrence flag is set to be 1 from 0, and an increment (+1) of the number of occurrences of the voltage variation event is made, and event information including the number of occurrences thereof is recorded in the memory 60 by the ECU 6 (see FIG. 5). The number of occurrences is also the number of settings of the voltage-variation occurrence flag. The number of occurrences increases whenever the voltage variation event occurs, and therefore the ECU 6 updates the contents recorded in the memory 60. The memory 60 is an example of an event information recorder in a preferred embodiment of the present invention. The recording timing of event information may be immediately after the ECU 6 makes an increment of the number of occurrences, or may be timing at which a main switch (not shown) of the outboard motor 1 is turned off later. When either of the operation flags that have been simultaneously set about the steering wheel 10 and the tilt switch 12 is reset, the ECU 6 also resets the voltage-variation occurrence flag (see FIG. 5).

If the power-source voltage in the outboard motor 1 becomes lower than the predetermined threshold value, the timing of the fuel-pressure feedback control performed by the EDU 61 will be delayed because the supply voltage to the EDU 61 decreases, and there is a concern that a fuel-pressure variation will occur because of a defect in the driving of the high-pressure fuel pump 39 resulting from the delay. The fuel-pressure variation is a possible cause of rotation fluctuation of the internal combustion engine 5.

However, in the outboard motor 1, if the power-source voltage in the outboard motor 1 that is detected by the power-source voltage detector 63 becomes lower than the predetermined threshold value and if the plurality of electric actuators are simultaneously driven, the ECU 6 determines that a voltage variation event has occurred. Furthermore, event information including the number of occurrences of the voltage variation event is recorded in the memory 60. In other words, regardless of whether a rotation fluctuation has occurred or not, information about the operation of the internal combustion engine 5 that might cause the rotation fluctuation is recorded as event information. Therefore, when the rotation fluctuation of the internal combustion engine 5 occurs, it is possible for an operator to utilize event information as a hint for specifying the cause of the rotation fluctuation. For example, if the number of occurrences of a voltage variation event and the number of occurrences of a defect in the internal combustion engine 5 substantially coincide with each other, the possibility that a voltage variation might be a cause of the defect is high, and therefore the operator is able to examine the capacity boost, the addition, and the like of the power source 62 as a solution to the defect. On the contrary, if the number of occurrences of a voltage variation and the number of occurrences of a defect in the internal combustion engine 5 do not obviously coincide with each other, the possibility that the voltage variation might be a cause of the defect is low, and therefore the operator is able to divide the voltage variation from the cause of the defect and swiftly advance to another cause investigation. Therefore, it is possible to shorten the period of time to specify the cause of the rotation fluctuation.

Particularly if the power-source voltage in the outboard motor 1 becomes lower than the predetermined threshold value and if the electric tilt actuator 28 and the electric steering actuator 26 are simultaneously driven, the ECU 6 determines that a voltage variation event has occurred, and event information is recorded in the memory 60. In this case, when event information is utilized to specify the cause of a defect of the internal combustion engine 5, the operator is able to consider a relationship between the cause of the defect and the simultaneous driving of the electric tilt actuator 28 and the electric steering actuator 26 that have high power consumption. Therefore, the operator is able to specify the cause of the defect in a short time.

The fact that the occurrences of rush currents have coincided with each other because a time difference in driving-start timing between the plurality of electric actuators simultaneously driven falls within a predetermined period of time may be considered as a possible cause for which the power-source voltage has become lower than the predetermined threshold value. Therefore, when event information is used to specify the cause of a defect of the internal combustion engine 5, the operator is able to consider rush currents, and hence specify the cause of the defect in a short time.

The ECU 6 is able to perform external output of event information recorded in the memory 60 via the event information output 64. The event information output 64 may be a device capable of writing event information into a portable storage medium (not shown), such as a USB memory, or may be a device to which a telecommunication cable is connected and that outputs event information via the telecommunication cable. When a defect occurs in the internal combustion engine 5, the operator allows, for example, his/her own terminal to read the contents of a portable recording medium, or connects a telecommunication cable of the terminal to the event information output 64 and receives the event information into the terminal. This enables the operator to browse the event information in the terminal. Therefore, the operator is able to specify the cause of the defect of the internal combustion engine 5 in a short time by using the event information.

Figure 3:
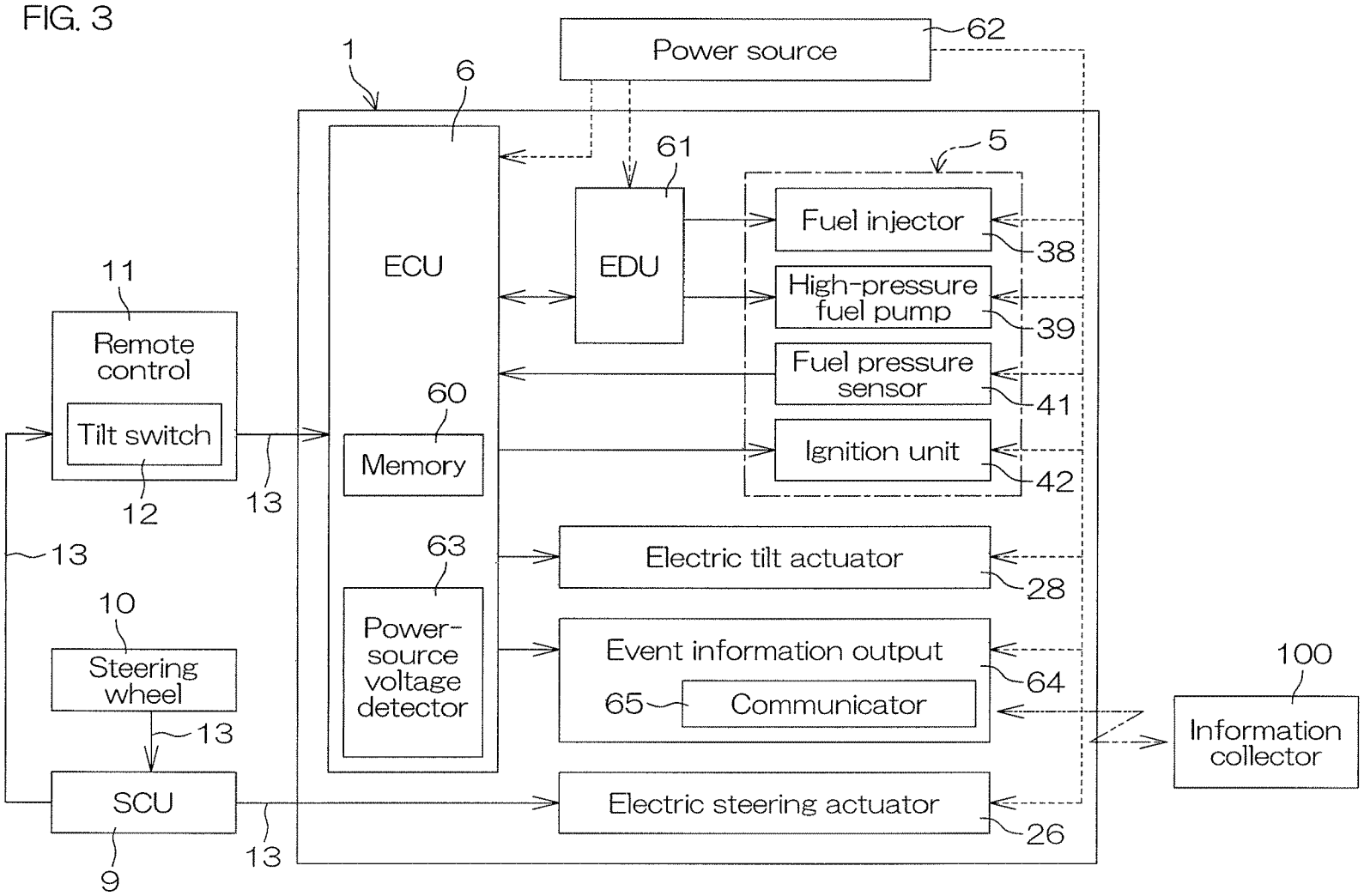
FIG. 3 is a block diagram showing an electric configuration of the outboard motor.

The event information output 64 includes a communicator 65 including an interface for communication and the like (see FIG. 3). The ECU 6 may perform wireless communication with an information collector 100 (see FIG. 3) of a database or the like provided outside the outboard motor 1 through a public line (not shown) connected to the communicator 65. For example, when there is a request to send event information from the information collector 100, the ECU 6 is capable of transmitting the event information to the information collector 100 via the communicator 65. As a result, the operator is able to analyze the defect of the internal combustion engine 5 by using event information displayed on a display screen (not shown) of the information collector 100 and specify the cause of the defect in a short time even when the operator is away from the outboard motor 1.

Although only the number of occurrences of a voltage variation event may be included in event information recorded in the memory 60, a time at which a voltage variation event has occurred may also be included besides the number of occurrences of a voltage variation event (see FIG. 6). If the number of occurrences of a voltage variation event and the time at which the voltage variation event has occurred are included in the event information, the operator is able to identify the occurrence time of a voltage variation event from the event information when the operator uses the event information in order to specify the cause of a defect of the internal combustion engine 5. As a result, the possibility that the voltage variation will cause the defect is high if the occurrence time of the voltage variation event and the occurrence time of the defect of the internal combustion engine 5 substantially coincide with each other. On the contrary, if the occurrence time of the voltage variation event and the occurrence time of the defect of the internal combustion engine 5 do not obviously coincide with each other, the possibility that the voltage variation will cause the defect is low, and therefore the operator is able to swiftly investigate another cause. Therefore, it is possible to further shorten the period of time required to specify the cause of the defect of the internal combustion engine 5.

Although the preferred embodiments of the present invention have been described above, the present invention is not restricted to the contents of these preferred embodiments and various modifications are possible within the scope of the present invention.

For example, the outboard motor 1 may include an electric shift actuator (not shown) that actuates the shift mechanism 49 in accordance with the operation of the operation lever 11A by the vessel operator. In this case, the electric shift actuator, without being limited to the electric steering actuator 26 and to the electric tilt actuator 28, may also be a to-be-determined object when whether a voltage variation event has occurred is determined. Additionally, the outboard motor 1 may be a hybrid-type outboard motor that rotates the propeller 4 via the internal combustion engine 5 and an electric motor (not shown), and this electric motor may also be a to-be-determined object when whether a voltage variation event has occurred is determined. Additionally, an air conditioner, an electric winch, an electric variable flap, etc., that are mountable in the hull 3 may also be to-be-determined objects when whether a voltage variation event has occurred is determined.

If three or more electric actuators are present, the ECU 6 ascertains in step S2 whether the three or more electric actuators that are respectively to-be-determined objects have been simultaneously driven. Thereafter, in step S3, the ECU 6 ascertains whether a time difference in driving-start timing between the electric actuator that has firstly started to be driven and the electric actuator that has lastly started to be driven among the electric actuators falls within a predetermined period of time.

When the occurrence of a voltage variation event is judged, step S3 mentioned above may be excluded. In this case, if the plurality of electric actuators are simultaneously driven (step S2: YES), the ECU 6 may determine that a voltage variation event has occurred even if the time difference in driving-start timing between the electric actuators does not fall within the predetermined period of time (step S4).

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor that generates a thrust while using an internal combustion engine as a power source, the outboard motor comprising:

a plurality of electric actuators;

a power-source voltage detector that detects a power-source voltage in the outboard motor;

a controller configured or programmed to include an event occurrence detector that determines that a voltage variation event has occurred only when both a power-source voltage detected by the power-source voltage detector becomes lower than a predetermined threshold value and the plurality of electric actuators are simultaneously driven; and an event information recorder that records event information including a number of occurrences of the voltage variation event.

2. The outboard motor according to claim 1, further comprising:

a mounting bracket to mount the outboard motor on a hull;

a tilt bracket attached so as to be tiltable with respect to the mounting bracket in an up-down direction; and an outboard motor body mounted so as to be steerable rightwardly and leftwardly with respect to the tilt bracket; wherein the plurality of electric actuators include:

an electric tilt actuator that tilts the tilt bracket with respect to the mounting bracket; and an electric steering actuator that steers the outboard motor body rightwardly and leftwardly with respect to the tilt bracket.

3. The outboard motor according to claim 1, wherein the event information recorder records the event information that includes the number of occurrences of the voltage variation event and an occurrence time of the voltage variation event.

4. The outboard motor according to claim 1, wherein, in a case in which a power-source voltage detected by the power-source voltage detector becomes lower than a predetermined threshold value and in which the plurality of electric actuators have been simultaneously driven, the event occurrence detector determines that the voltage variation event has occurred if a time difference in driving-start timing between the plurality of electric actuators falls within a predetermined period of time.

5. The outboard motor according to claim 1, further comprising an event information output that outputs event information recorded in the event information recorder.

6. The outboard motor according to claim 5, wherein the event information output includes a communicator that communicates with an information collector provided outside the outboard motor.

7. The outboard motor according to claim 1, wherein the internal combustion engine includes a fuel injector and a high-pressure fuel pump that supplies fuel to the fuel injector; and the controller is configured or programmed to perform fuel-pressure feedback control of the high-pressure fuel pump.

* * * * *